US010151080B2

(12) United States Patent
Sewell

(10) Patent No.: US 10,151,080 B2
(45) Date of Patent: Dec. 11, 2018

(54) VALVE ASSEMBLY FOR WORK ATTACHMENT

(71) Applicant: The Charles Machine Works, Inc., Perry, OK (US)

(72) Inventor: Cody L. Sewell, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 57 days.

(21) Appl. No.: 15/365,561

(22) Filed: Nov. 30, 2016

(65) Prior Publication Data

US 2017/0152646 A1 Jun. 1, 2017

Related U.S. Application Data

(60) Provisional application No. 62/261,145, filed on Nov. 30, 2015.

(51) Int. Cl.

| | |
|---|---|
| ***E02F 9/22*** | (2006.01) |
| ***E02F 5/08*** | (2006.01) |
| ***E02F 7/04*** | (2006.01) |
| ***E02F 3/18*** | (2006.01) |
| ***E01C 23/09*** | (2006.01) |
| ***E02F 3/96*** | (2006.01) |
| ***E02F 5/14*** | (2006.01) |

(52) U.S. Cl.

CPC ..... *E02F 9/2217* (2013.01); *E01C 23/0933* (2013.01); *E02F 3/183* (2013.01); *E02F 3/188* (2013.01); *E02F 3/967* (2013.01); *E02F 5/08* (2013.01); *E02F 5/145* (2013.01); *E02F 7/04* (2013.01); *E02F 9/2203* (2013.01)

(58) Field of Classification Search

CPC . E02F 5/08; E02F 5/145; E02F 9/2267; E02F 9/2271; E02F 9/2279; E02F 9/2275

USPC ..... 37/347, 348

See application file for complete search history.

(56) References Cited

U.S. PATENT DOCUMENTS

| | | | | |
|---|---|---|---|---|
| 5,802,847 | A * | 9/1998 | Harnischfeger | E02F 9/2207 60/413 |
| 9,681,601 | B2 * | 6/2017 | Bassett | A01C 7/205 |
| 2005/0067239 | A1 * | 3/2005 | Bauer | B60G 17/056 188/297 |
| 2005/0193887 | A1 * | 9/2005 | Koizumi | F16K 31/1226 91/471 |
| 2007/0051100 | A1 * | 3/2007 | Kauss | E02F 9/2207 60/413 |
| 2009/0045022 | A1 * | 2/2009 | Scholl | B60G 17/08 188/266.5 |

(Continued)

*Primary Examiner* — Alicia Torres

(74) *Attorney, Agent, or Firm* — Tomlinson McKinstry, P.C.

(57) ABSTRACT

A hydraulic control for an attachment on a work vehicle. The attachment is mounted on the chassis of the work vehicle and movable between a first position and a second position. A hydraulic cylinder is operable to power movement of the attachment. A fluid circuit communicates with the hydraulic cylinder and is configured to carry hydraulic fluid. A fluid reservoir is in communication with the fluid circuit. Accumulators that are in communication with the fluid circuit automatically store and release hydraulic fluid in response to movement of the attachment. A valve assembly controls fluid communication between the fluid reservoir and the fluid circuit in response to movement of the attachment to its second position.

20 Claims, 9 Drawing Sheets

(56) References Cited

U.S. PATENT DOCUMENTS

| | | | | |
|---|---|---|---|---|
| 2009/0212473 | A1* | 8/2009 | Matsuzaki | B60G 11/26 267/64.22 |
| 2009/0261541 | A1* | 10/2009 | Huth | B60G 17/0152 280/5.507 |
| 2011/0197573 | A1* | 8/2011 | Honsbein | E02F 9/2207 60/413 |
| 2011/0197576 | A1* | 8/2011 | Wada | E02F 9/2217 60/413 |
| 2013/0125539 | A1* | 5/2013 | Kobayashi | E02F 9/2207 60/413 |
| 2014/0196996 | A1* | 7/2014 | Ito | B05B 13/005 188/266.2 |
| 2015/0225928 | A1* | 8/2015 | Wu | F15B 21/14 60/413 |
| 2017/0002840 | A1* | 1/2017 | Oobayashi | F15B 11/02 |
| 2017/0211597 | A1* | 7/2017 | Vigholm | F15B 11/028 |
| 2017/0284064 | A1* | 10/2017 | Hijikata | E02F 9/2217 |

* cited by examiner

VALVE ASSEMBLY FOR WORK ATTACHMENT

CROSS REFERENCE TO RELATED APPLICATION

This application claims the benefit of U.S. Provisional Patent Application Ser. No. 62/261,145 filed on Nov. 30, 2015, the entire contents of which are incorporated herein by reference.

FIELD

This invention relates generally to a system for controlling operation of a work attachment.

SUMMARY

The invention is directed to a work machine. The work machine comprises a chassis, a work attachment, a hydraulic cylinder, a fluid circuit, a fluid reservoir, a first accumulator, and a valve assembly. The work attachment is mounted on the chassis and movable between a first position and a second position. The hydraulic cylinder is operable to power movement of the work attachment. The fluid circuit communicates with the hydraulic cylinder and is configured to carry hydraulic fluid. The fluid reservoir is in communication with the fluid circuit. The first accumulator is in communication with the fluid circuit and configured to automatically store and release hydraulic fluid in response to movement of the work attachment. The valve assembly is adapted to control fluid communication between the fluid reservoir and the fluid circuit in response to movement of the work attachment to its second position.

In another embodiment, the invention is directed to an assembly. The assembly comprises a frame, an excavator, a first hydraulic cylinder, a fluid circuit, a fluid reservoir, a first accumulator, and a valve assembly. The frame supports the excavator. The first hydraulic cylinder is operable to power movement of the excavator. The fluid circuit communicates with the hydraulic cylinder and is configured to carry hydraulic fluid. The fluid reservoir is in communication with the fluid circuit. The first accumulator is in communication with the fluid circuit and configured to automatically store and release hydraulic fluid in response to movement of the excavator. The valve assembly is adapted to control fluid communication between the fluid reservoir and the fluid circuit in response to movement of the work attachment.

DESCRIPTION OF THE PREFERRED EMBODIMENTS

Figure 1:
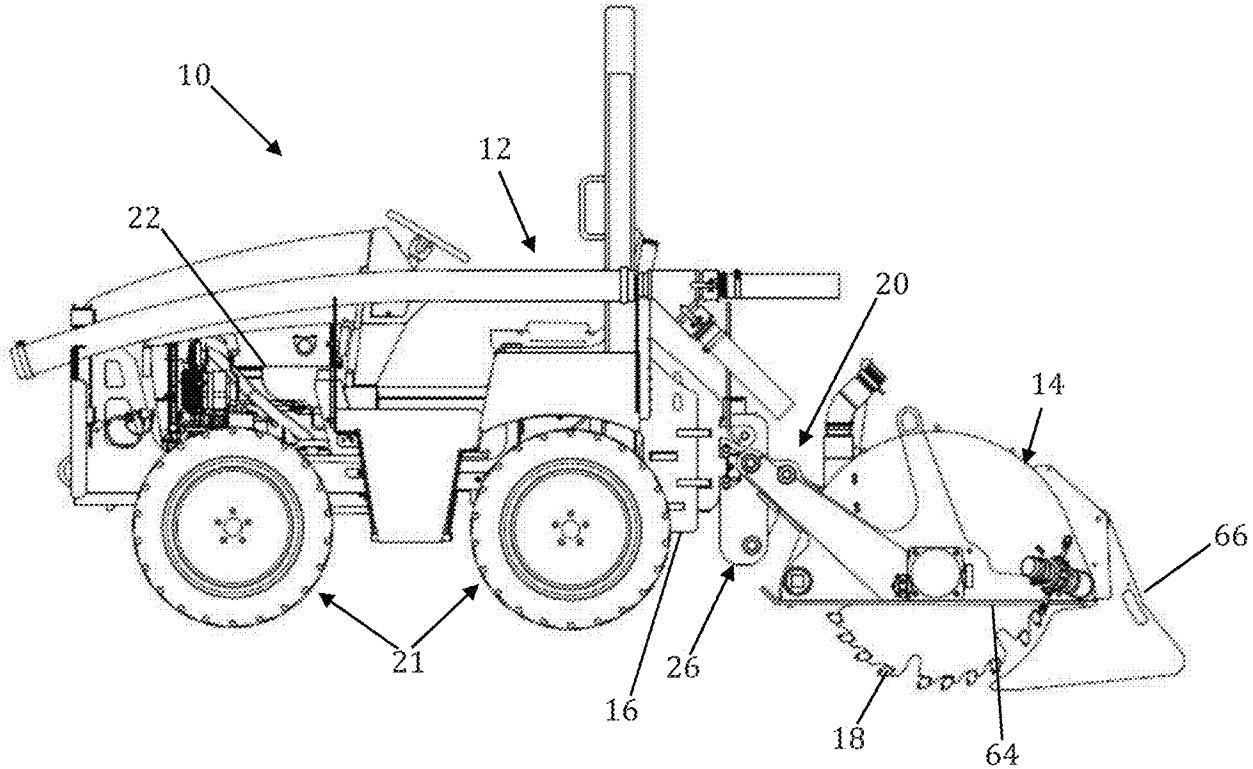
FIG. 1 is a side view of a tractor having an excavator work attachment.

With reference to FIG. 1, a work vehicle 10 with an operator station 12, and a work attachment 14 is shown. In FIG. 1, the work vehicle is a tractor having a chassis 16. As shown, the work attachment 14 is positioned at a back end of the chassis 16. The work attachment 14 shown is an excavator comprising a trencher 18. Other attachments, such as vibratory plows, buckets, microtrenching assemblies, stump grinders, and the like may be utilized with the chassis 16 and control system disclosed herein.

When the work attachment 14 is active, it rotates the excavator 18 to excavate dirt and or a ground covering such as concrete or asphalt. As the contour of the ground surface changes up and down, the work attachment 14 may move up-and-down. The present invention comprises a lift assembly 20 that is configured to adjust the down pressure exerted on the work attachment 14 so that it will maintain contact with the ground without adjustment by or constant input from the operator.

Figure 6:
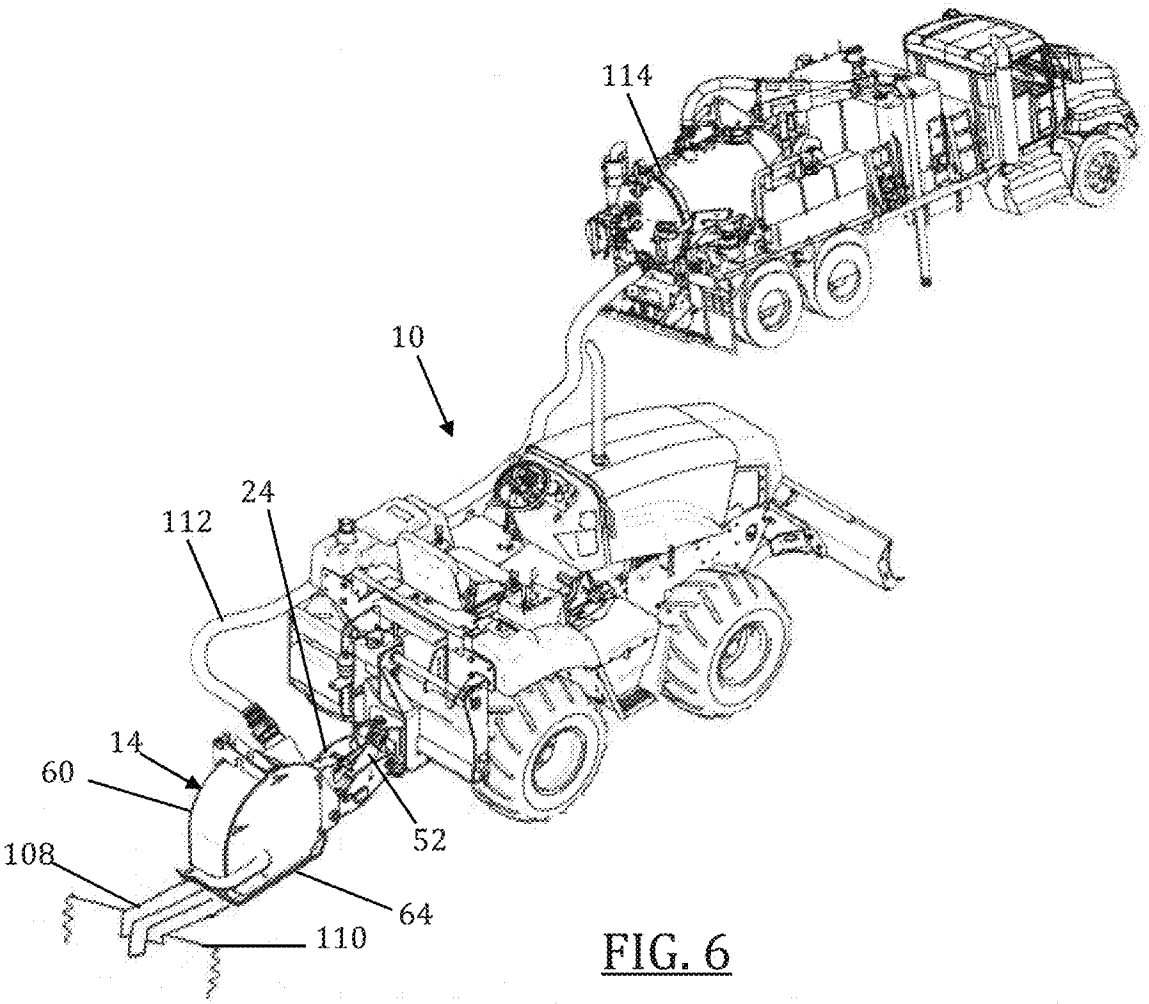
FIG. 6 is an overall diagrammatic representation of the tractor and work attachment shown being used to create a trench.
Figure 7:
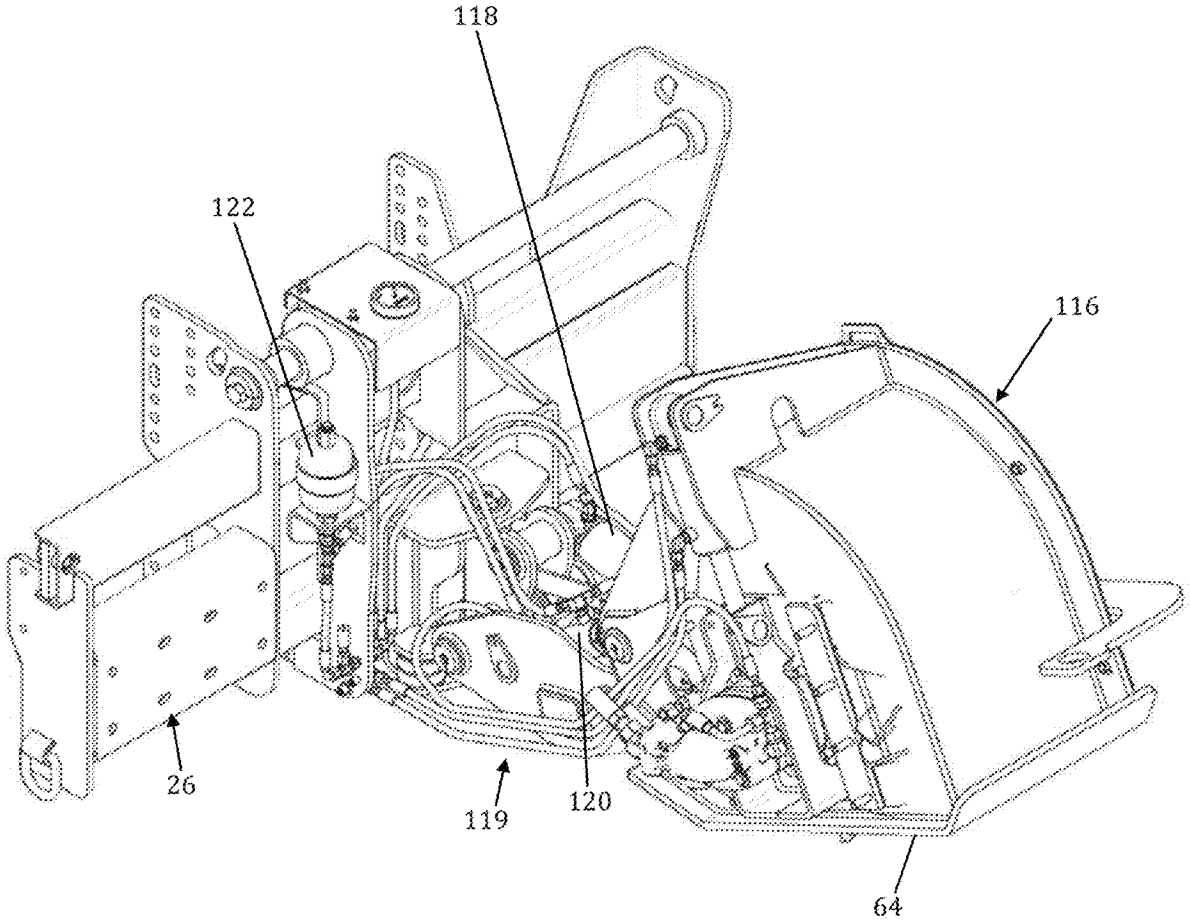
FIG. 7 is a back left perspective view of an alternative work attachment having an alternative hydraulic system for controlling a down force on the work attachment.
Figure 8:
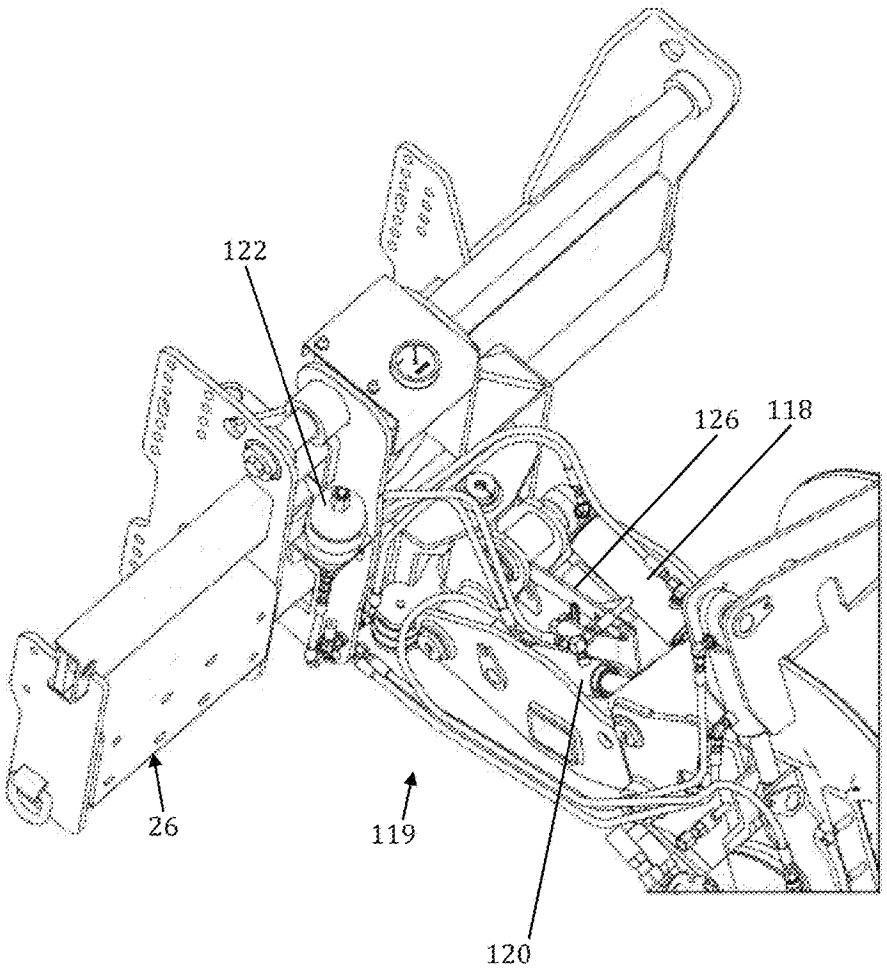
FIG. 8 is a top perspective view of the work attachment shown in FIG. 7.

With reference now to FIGS. 1-4, the work machine 10 comprises a chassis 16, a propulsion system 21 supported on the chassis, and the work attachment 14. As mentioned above, the work machine 10 may be a tractor and the propulsion system 21 may comprise a plurality of wheels configured to move the chassis in a plurality of directions. The work attachment 14 is mounted on the chassis 16 and movable between a first position, raised away from the ground, and a second position, lowered to the ground 110 as shown in FIG. 6.

The tractor has a power source 22 that may comprise an internal combustion engine supported on the chassis 16. The power source 22 may power operation of the propulsion system 21, the work attachment 14, and the lift assembly 20.

Figure 5:
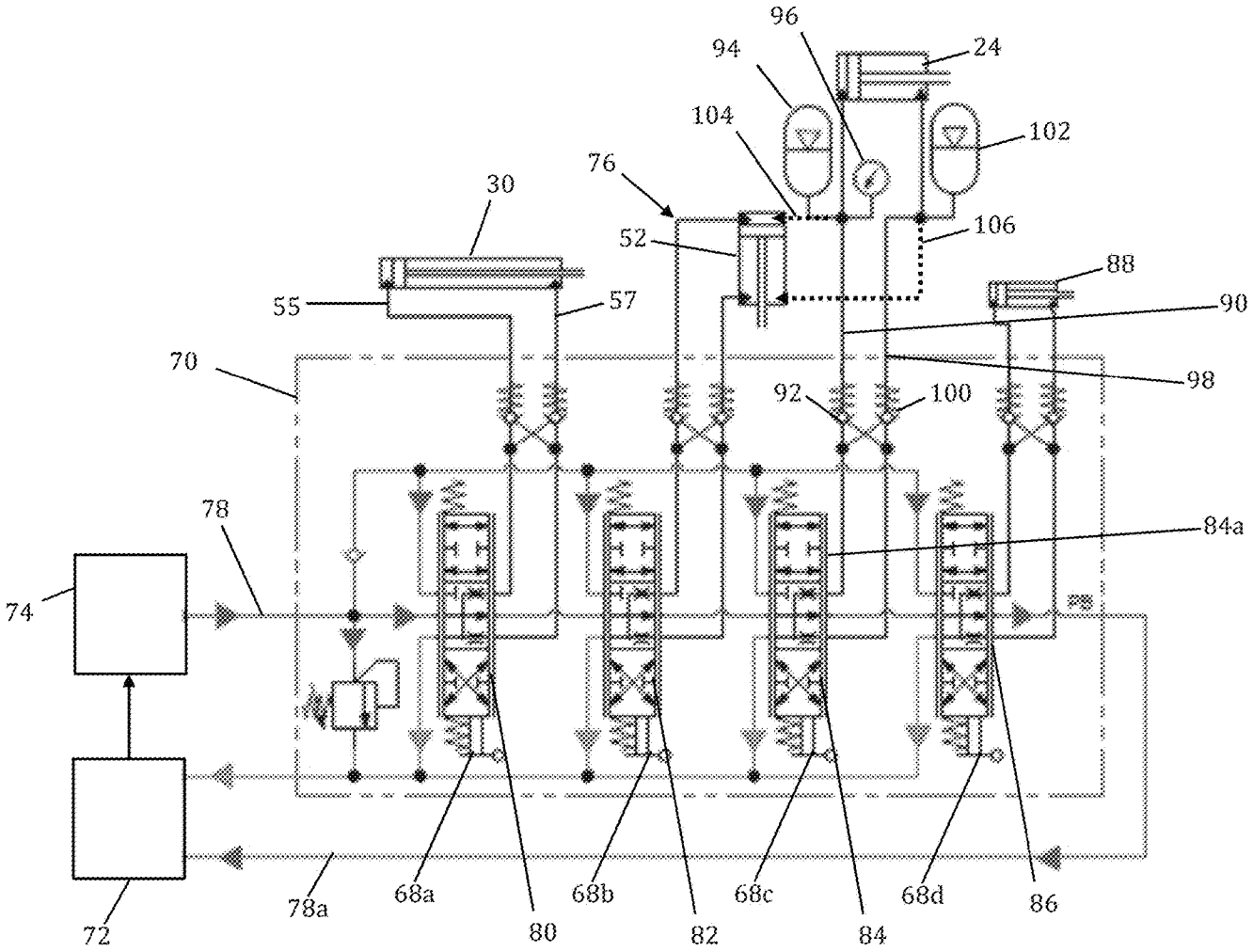
FIG. 5 is a schematic of a hydraulic control valve assembly for the work machine wherein one of the valves is used with a pair of accumulators to store and release hydraulic fluid in response to movement of the work attachment.

The lift assembly 20 is supported on the chassis 16 by an attachment frame 26. The attachment frame 26 has a top rail 28 along which the work attachment 14 may be moved along. As shown in FIG. 5, a hydraulic cylinder 30 may move the lift assembly 20 along the rail 28. As discussed hereinafter, the lift assembly 20 comprises a plurality of interconnected arms and frame members that are configured to permit movement of the work attachment 14 about a plurality of axes. This configuration permits the operator to position the work attachment 14 at a desired orientation for excavation operations.

The lift assembly 20 has a pair of vertical support members 32 that are mounted on the top rail 28. A mounting sleeve 33 is positioned between the support members 32 and a hole 34 is formed in one end of each member to receive the sleeve. The sleeve has an inner diameter that permits it to fit around and slide along the top rail 28.

The work attachment 14 may be pivoted left or right about a vertical axis 38 defined by a pivot member 40. The pivot member 40 is connected to the vertical support members 32 by a pivot pin 42 that is coaxially aligned with the vertical axis 38. The pivot member 40 has triangular-shaped top and bottom plates and may be constructed from steel. The pivot pin 42 extends between the top plate and the bottom plate and is configured to support a sleeve 44 that surrounds the pivot pin. The sleeve 44 is connected to a lift arm 46.

The lift arm 46 has a first end and a second end. The first end of the lift arm 46 is connected to the pivot member 40 and the second end is connected to the work attachment 14. The lift arm 46 is connected to the pivot member 40 using a pivot pin 48 so that the lift arm is movable relative to the pivot member 40 about a horizontal pivot axis 50 defined by pin 48. A hydraulic cylinder 52 is connected at a barrel end to the pivot member 40 at connection point 54 and at a rod end to the lift arm 46 at connection point 56. When the cylinder 52 is extended, the lift arm 46 is lowered, thereby lowering the work attachment 14 to engage the ground surface. Retracting the cylinder 52 causes the lift arm 46 to raise and lift the work attachment 14 from the ground. Hydraulic fluid is supplied to the barrel side of cylinder 52 through line 55 and to the rod side through line 57.

The work attachment 14 is supported at the second end of the lift arm 46. A work attachment frame 61 connects the work attachment 14 to the lift arm 46. The connection between the lift arm 46 and work attachment frame 61 is made with a pivot pin 50 so that the work attachment 14 may tilt relative to the lift assembly 20.

A hydraulic motor 58 is used to rotate the excavator 18. The hydraulic motor 58 is supplied with hydraulic fluid through lines 57. The excavator 18 may be partially covered by a hood 60 supported on the work attachment frame 61. The excavator 18 may be movable up and down relative to the hood 60 using an adjustment cylinder 62 supported on the hood and connected to the excavator.

The first cylinder 24 is connected to the hood 60 at its rod end and the lift arm 46 at its barrel end. Actuation of the first cylinder 24 tilts the work attachment 14 to orient the ground-engaging surface of the hood 60 and the trench cleaner 66 to a desired pitch about pivot point 59.

Operation of the excavator 18 and the lift assembly 20 may be controlled at the operator station 12 by one or more of a plurality of levers 68 configured to operate a valve assembly 70. The valve assembly 70 is adapted to control fluid communication between a fluid reservoir 72 (FIG. 5) and the hydraulic components used to operate the lift assembly 20 and the work attachment 14.

Figure 3:
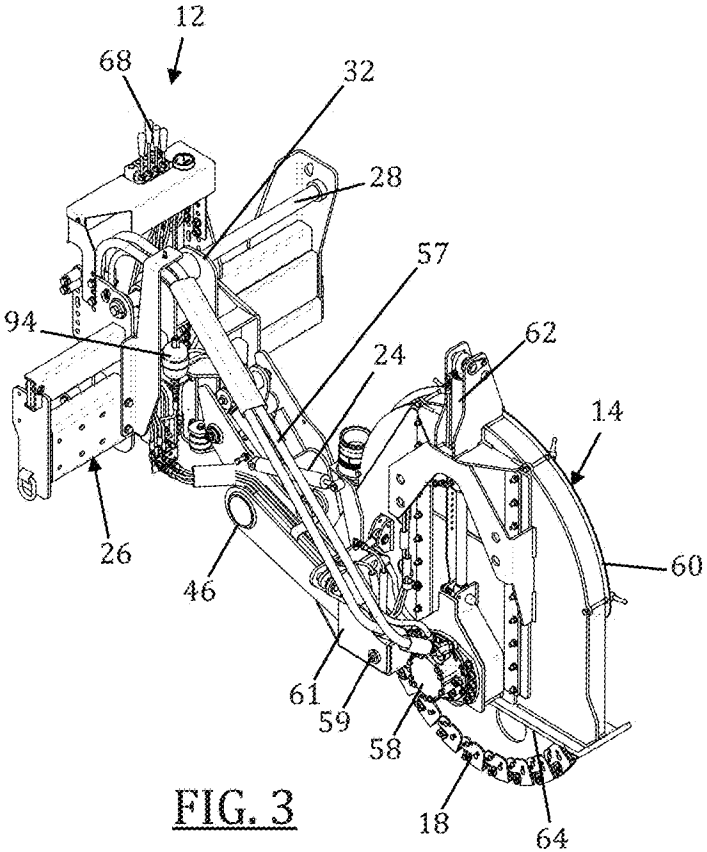
FIG. 3 is a back left perspective view of the work attachment shown in FIG. 2 showing operator controls, lift assembly, and hydraulic conduits used to operate the excavator.
Figure 2:
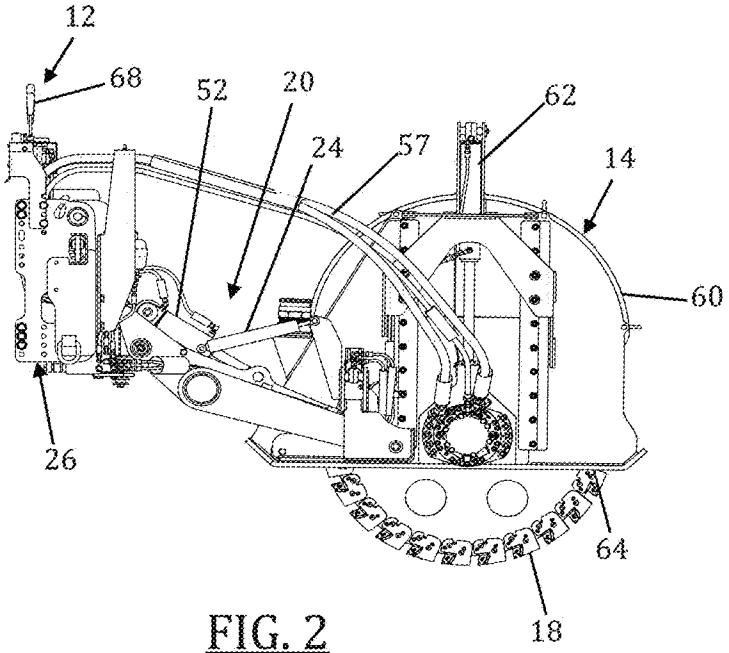
FIG. 2 is a close-up side view of the excavator work attachment shown in FIG. 1 with the trench cleaner removed for clarity.
Figure 4:
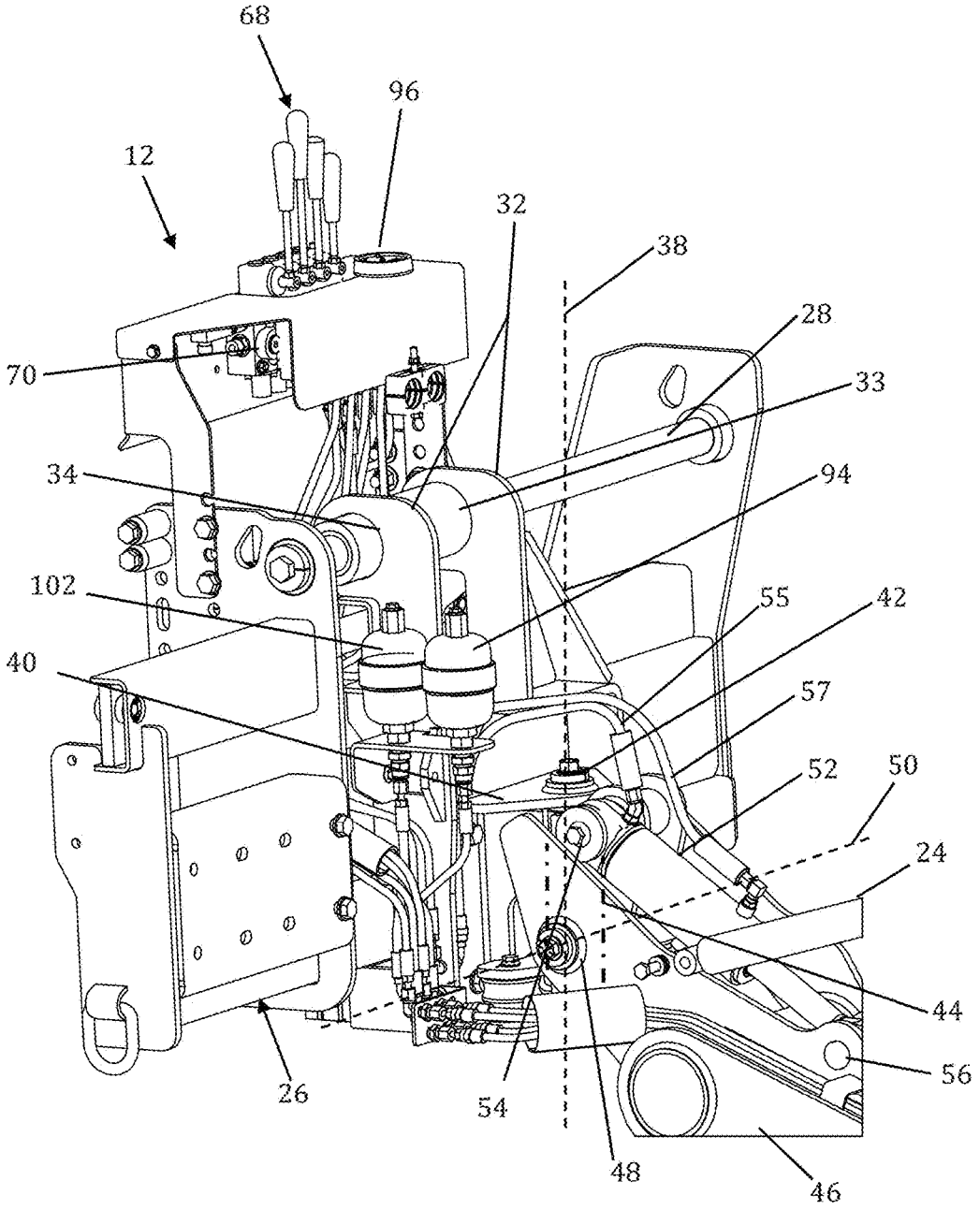
FIG. 4 is a close-up view of the hydraulic system shown FIGS. 2 and 3 from a back left perspective view.

Turning now to FIG. 5, with continuing reference to FIGS. 2-4, a fluid circuit 76 for the lift assembly 20 is shown. The fluid circuit 76 is supplied hydraulic fluid by a pump 74 supported on the work machine 10. The pump 74 pulls hydraulic fluid from a fluid reservoir 72 and pumps the fluid into the fluid circuit 76. The fluid circuit 76 comprises fluid conduits, the valve assembly 70, and a plurality of check valves.

The valve assembly 70 may comprise four (4) valves 80, 82, 84, and 86 configured to control the flow of fluid to various components of the lift assembly. Each of the valves may comprise an infinite position valve. Each valve may be actuated by a lever 68 that corresponds to a single valve.

Valve 80 is actuated by lever 68*a* and controls the flow of fluid to cylinder 30. Cylinder 30 is used to move the lift assembly 20 along the top rail 28 of the frame 26. Valve 82 is actuated by lever 68*b* and controls the flow of fluid to cylinder 52. Cylinder 52 is used to lift and lower the lift arm 46 connected to the work attachment 14. Valve 84 is actuated by lever 68*c* and controls the flow of fluid to the cylinder 24. As discussed above, cylinder 24 is used to tilt the work attachment 14. Valve 86 is actuated by lever 68*d* and controls the flow of fluid to cylinder 88. Cylinder 88 is used to control steering of the work machine 10 while the work attachment 14 is excavating.

When all valves are in the off position, fluid enters the line 78 and passes through the valves and is returned to the reservoir 72 through line 78*a*. However, when for example valve 84 is moved to the on position the flow of fluid through valve 84 is redirected through lines 90 and 98 to cylinder 24.

When the operator actuates lever 68*c* to move the valve to position 84*a* hydraulic fluid is permitted to enter into the barrel side of cylinder 24. This causes the rod to extend from cylinder 24 and move the work attachment from a first position to a second position to engage the ground 110, as shown in FIG. 6. The fluid flows through line 90 and check valve 92 to the barrel side of the cylinder 24. However, a portion of the fluid is diverted from line 90 to a first accumulator 94 in communication with line 90. The first accumulator 94 may comprise a gas-pressurized accumulator with a diaphragm. As discussed hereinafter, the first accumulator 94 is configured to automatically store and release hydraulic fluid in response to movement of the work attachment 14 after the work attachment has reached a desired position and the operator has released the lever 68*c*. A pressure indicator 96 may also be in fluid communication with line 90 to monitor the pressure of the fluid in line 90.

Hydraulic fluid is also supplied from valve 84 to the rod side of cylinder 24. Fluid is supplied to the rod side through line 98. Check valve 100 prevents the back flow of fluid in line 98. Supplying fluid to the rod side of cylinder 24 will cause the cylinder rod to retract into the barrel and move the work attachment back to the first position. For example, retraction of the cylinder rod may cause the work attachment 14 to tilt in a counter-clockwise direction. Whereas, extension of the rod will cause the work attachment 14 to tilt in a clockwise direction.

A portion of the hydraulic fluid pumped through line 98 may be diverted to a second accumulator 102. The second accumulator 102 is also configured to automatically store and release hydraulic fluid in response to movement of the work attachment 14. However, the second accumulator 102 stores and releases hydraulic fluid to the rod side of cylinder 24.

In operation, the lever 68*c* is actuated to open the valve 84 to provide fluid to the barrel side of the cylinder 24 to extend the cylinder rod and move the work attachment 14 to a desired position. Hydraulic fluid is also stored in the first accumulator 94. When the operator releases the lever 68*c* the valve 84 will close and the work attachment 14 will remain in the desired position. However, as the work attachment 14 is pulled across the ground 110 by the work machine 10, as shown in FIG. 6, the contour of the ground may rise or fall. In response to such contour changes the first accumulator 94 increases or decreases pressure in the barrel side of the cylinder 24 to apply sufficient a down force on the work attachment 14 to maintain contact with the ground. Therefore, as the ground contour contacting the ground-engaging surface 64 of the hood 60 changes, the accumulator 94 will store or release hydraulic fluid as needed to maintain contact between surface 64 and the ground surface.

Likewise, the second accumulator 102 applies a constant pressure in the rod side of the cylinder 24. The second accumulator 102 releases or stores hydraulic fluid as needed to maintain a sufficient pressure in the rod side of the cylinder in response to changes in the contour of the ground to assist the first accumulator 94 to maintain contact between surface 64 and the ground.

In an alternative embodiment, the first accumulator 94 may also be in fluid communication with the barrel side of lift cylinder 52 via line 104. Likewise, the second accumulator 102 may communicate with the rod side of both 52 via line 106. This configuration provides refined contour following utilizing both the lift and tilt range of motion of the work attachment 14 to maintain down force on the work attachment 14 and contact between the ground-engaging surface 64 of the hood 60 and the ground.

FIG. 6 shows the work machine 10 on which the work attachment 14 is used to form a trench 108 in a surface of the ground 110. The work attachment is mounted to the work machine 10 and positioned on the ground 110. The motor 58 (FIG. 3) rotates the excavator 18 (FIG. 3) while the work machine 10 pulls the work attachment 14 over the ground to form the trench 108.

As the excavator 18 cuts through the ground 110, spoils are formed in the trench 108 and turned up into the hood 60. Maintaining contact between the ground-engaging surface 64 of the hood 60 and the ground 110 helps contain the spoils within the hood. The spoils are carried away by the vacuum system 112 to a truck or trailer mounted vacuum tank 114. Containing the spoils and vacuuming them away are beneficial to clean the trench 108 and to reduce the amount of dust and debris that escapes into the ambient air.

The hydraulic system of the present invention is particularly useful to maintain contact between the ground 110 and the ground-engaging surface 64 of the hood 60. Because the system maintains contact between the ground and surface 64, the excavator 18 supported within the hood also cuts the trench 108 at a constant depth relative to the ground surface 110.

Turning now to FIGS. 7-10, an alternative lift assembly 119 and work attachment 116 will be discussed. The work attachment 116 shown in FIGS. 7-10 is a microplaner as disclosed in co-pending U.S. patent application Ser. No. 15/290,704 filed Oct. 11, 2016, the contents of which are incorporated herein fully by this reference. The lift assembly 119 of FIGS. 7-10 differs from the embodiment shown in FIGS. 1-6 in that a single accumulator 122 is used with a float valve 124.

Like lift assembly 20, lift assembly 119 comprises a lift actuator 118 and a tilt actuator 120. Both actuators 118 and 120 may comprise hydraulic cylinders. As discussed above with reference to lift assembly 20, a valve assembly may control the flow of fluid to both actuators in lift assembly 119. Both actuators 118 and 120 extend between the work attachment 116 and the frame 26 mounted on the chassis 16 (FIG. 1).

The lift 118 and tilt 120 actuators are both operatively connected to the accumulator 122 via the float control valve 124. The float valve 124 is configured to enable the pressure on the rod side of both the lift 118 and tilt 120 actuators to be reduced to zero when activated. The accumulator 122 applies a constant pressure to the barrel side of both actuators 118 and 120, applying a down force on the excavator 18. The constant pressure in actuators 118 and 120 also permits the actuators to respond to increases in either the tilt of the work attachment 116 or a change in the height of the attachment. Thus, as the ground contour contacting the ground-engaging surface 64 changes, the accumulator 122 will store or release hydraulic fluid as needed to maintain a constant pressure between lift and tilt actuators. This permits the work attachment 116 to follow the contour of the ground 110 without input from the operator of the machine.

Figure 9:
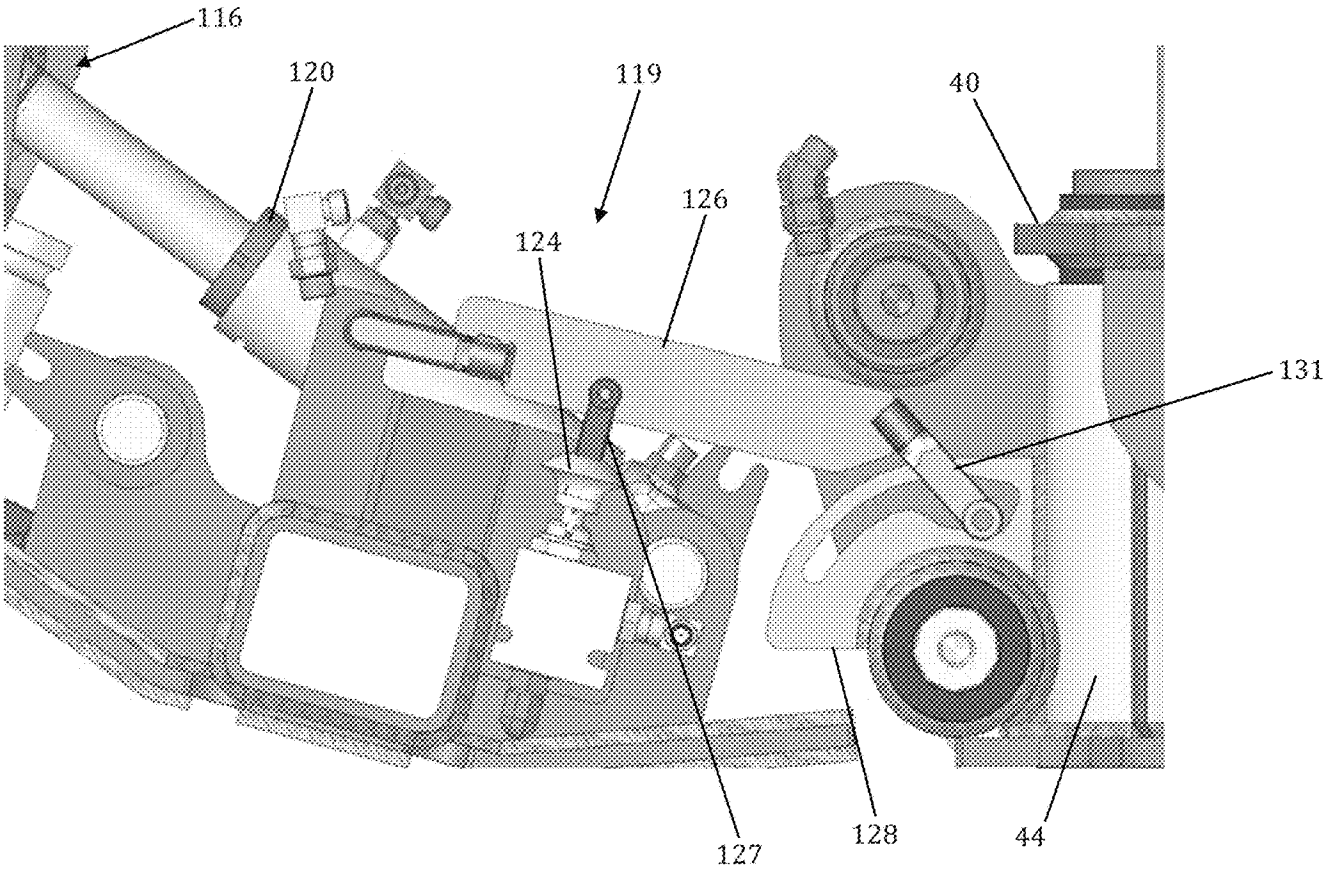
FIG. 9 is a close-up view of a float valve used with the hydraulic system shown in FIG. 7, in a disengaged position.
Figure 10:
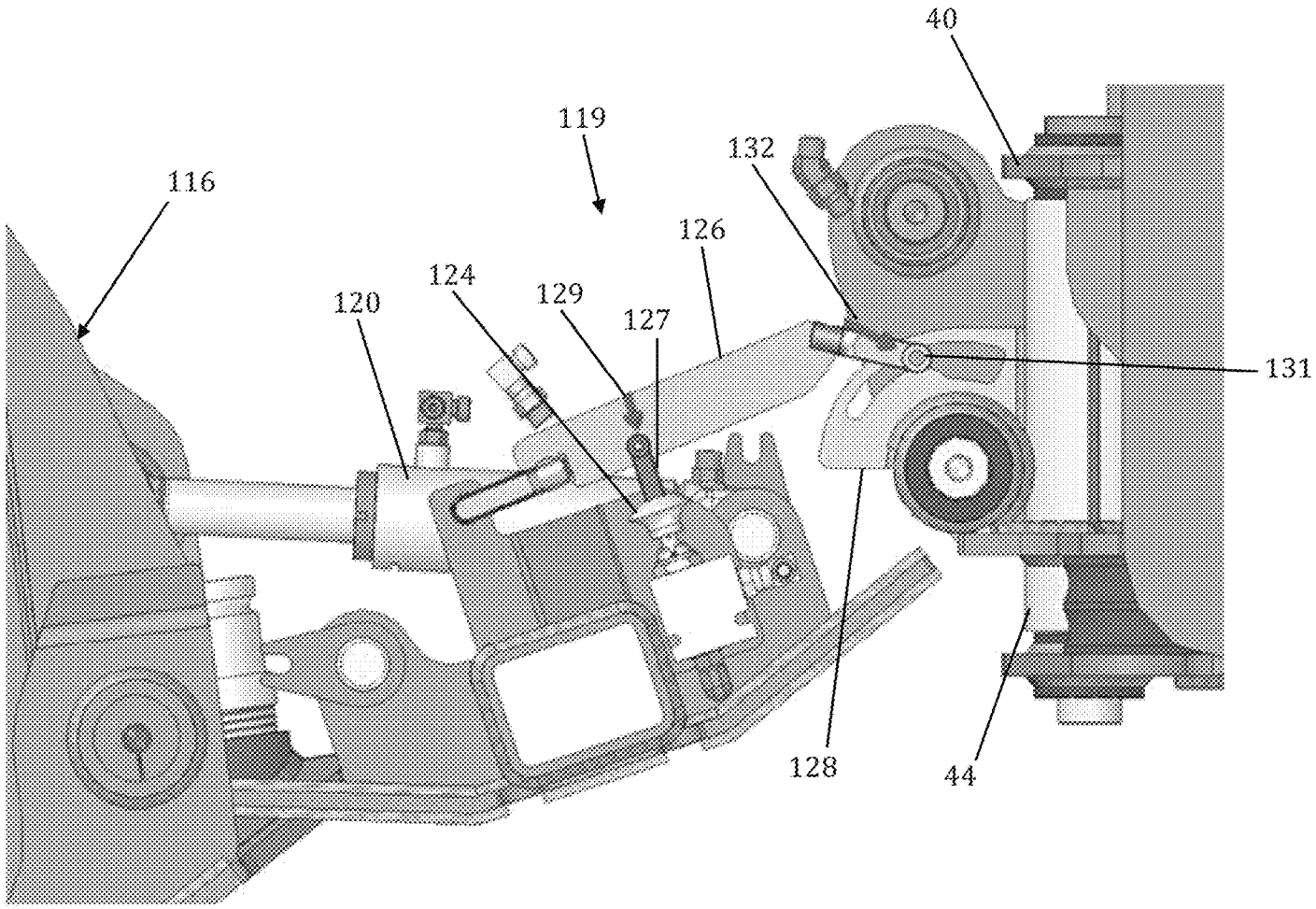
FIG. 10 is a close-up view of the float valve shown in FIG. 9, in an engaged position.

The lift assembly of FIGS. 7-10 uses a control arm 126 to activate and deactivate the float valve 124. The lift arm 126 is elongate and has opposed first and second ends. The first end is connected to the pivot member 40 in sliding engagement via a bracket 128. The second end of the control arm 126 is connected to the work attachment 14. The control arm 126 is connected to the float valve by a linkage 127. When the work attachment 116 is lowered, as shown in FIG. 10, the linkage moves in the direction of arrow 129 to depress the float valve plunger and activate the float valve and accumulator 122 to maintain a constant pressure in actuators 118 and 120.

When the work attachment 116 is in the raised position as shown in FIG. 9, the float valve is deactivated. Raising the work attachment 116 causes the control arm to lift upward and linkage 131 travels along the guide slot cut into bracket 128 in the direction of arrow 132. Thus, lift actuator 118 and tilt actuator 120 are independent and do not utilize the accumulator 122 as a source of common hydraulic pressure.

Modifications can be made in the design and operation of the present invention without departing from the spirit thereof. Thus, while the principal preferred construction and modes of operation of the invention have been explained in what is now considered to represent its best embodiments, which have been illustrated and described, it should be understood that the invention may be practiced otherwise than as specifically illustrated and described.

What is claimed is:

1. A work machine, comprising:

a chassis;

a work attachment mounted on the chassis and movable between a first position and a second position;

a first hydraulic cylinder operable to tilt the work attachment;

a fluid circuit that communicates with the first hydraulic cylinder and is configured to carry hydraulic fluid;

a fluid reservoir in communication with the fluid circuit;

a first accumulator in communication with the fluid circuit and configured to automatically store and release hydraulic fluid in response to movement of the work attachment; and a valve assembly adapted to control fluid communication between the fluid reservoir and the fluid circuit in response to movement of the work attachment to its second position.

2. The work machine of claim 1, in which the first accumulator is hydraulically connected to a barrel side of the first cylinder.

3. The work machine of claim 1, further comprising a second accumulator hydraulically connected to a rod side of the first cylinder.

4. The work machine of claim 1, in which the valve assembly comprises an infinite position valve.

5. The work machine of claim 4, further comprising a lever configured to actuate the infinite position valve.

6. The work machine of claim 1, in which the first accumulator is a gas pressurized accumulator.

7. The work machine of claim 1, in which the work attachment comprises an excavator.

8. An assembly, comprising:

a frame;

an excavator supported by the frame;

a first hydraulic cylinder operable to tilt the excavator;

a second hydraulic cylinder connected to the excavator to lift the excavator;

a fluid circuit that communicates with the first hydraulic cylinder and is configured to carry hydraulic fluid;

a fluid reservoir in communication with the fluid circuit;

a first accumulator in communication with the fluid circuit and configured to automatically store and release hydraulic fluid in response to movement of the excavator; and a valve assembly adapted to control fluid communication between the fluid reservoir and the fluid circuit in response to movement of the excavator.

9. The assembly of claim 8, in which the valve assembly comprises a first valve that controls hydraulic fluid flow to the first cylinder and first accumulator.

10. The assembly of claim 9, in which the valve assembly comprises a second valve that controls hydraulic fluid flow to the second cylinder.

11. The assembly of claim 8, in which the first accumulator is connected to a barrel side of the first cylinder.

12. The assembly of claim 11, further comprising a second accumulator connected to a rod side of the first cylinder and configured to provide cushioning, in cooperation with the first accumulator and first cylinder, between the excavator and the frame.

13. The assembly of claim 9 in which the first valve is a lever actuated infinite valve.

14. The assembly of claim 13, in which movement of the lever controls a down force on the excavator.

15. The assembly of claim 14, in which the first accumulator is positioned between the first cylinder and the first valve and maintains the down force on the excavator.

16. A tractor, comprising:

a chassis;

a propulsion system configured to move the chassis in a plurality of directions;

the assembly of claim 8 supported on the chassis; and a power source supported on the chassis that powers operation of the propulsion system, the excavator, and the first hydraulic cylinder.

17. The tractor of claim 16 further comprising an operator station having a lever configured to operate the valve assembly.

18. The tractor of claim 16, in which the valve assembly comprises first and second valves, the first valve controls hydraulic fluid flow to the first cylinder and first accumulator and the second valve controls hydraulic fluid flow to the second cylinder.

19. The work machine of claim 1 further comprising a second hydraulic cylinder to lift the work attachment.

20. The work machine of claim 1 wherein the work attachment comprises a trencher.

* * * * *